US005550440A

United States Patent [19]

Allison et al.

[11] Patent Number: 5,550,440

[45] Date of Patent: Aug. 27, 1996

[54] SINUSOIDAL INDUCTORLESS DIMMER APPLYING VARIABLE FREQUENCY POWER SIGNAL IN RESPONSE TO USER COMMAND

[75] Inventors: Greg R. Allison, North Stonington, Conn.; James D. Christensen, Portland; Thomas L. Folsom, Hillsboro, both of Oreg.

[73] Assignee: Electronics Diversified, Inc., Hillsboro, Oreg.

[21] Appl. No.: 340,756

[22] Filed: Nov. 16, 1994

[51] Int. Cl.[6] ..... G05F 1/00

[52] U.S. Cl. ..... 315/294; 315/295; 315/307; 315/194; 315/DIG. 4

[58] Field of Search ..... 315/294, 295, 315/312, 317, 307, 362, DIG. 4, 194, 209 R; 323/322, 242

[56] References Cited

U.S. PATENT DOCUMENTS

| | | | |
|---|---|---|---|
| 4,471,269 | 9/1984 | Ganser et al. | 315/307 |
| 4,527,198 | 7/1985 | Callahan | 315/291 X |
| 4,550,276 | 10/1985 | Callahan | 315/312 |
| 4,617,508 | 10/1986 | Bloomer | 315/194 X |
| 4,633,161 | 12/1986 | Callahan | 315/194 X |
| 4,649,323 | 3/1987 | Pearlman | 315/307 |
| 4,697,227 | 9/1987 | Callahan | 315/312 X |
| 4,703,412 | 10/1987 | Cunningham | 315/292 X |
| 4,788,474 | 11/1988 | Kokubu | 315/119 |
| 4,797,795 | 1/1989 | Callahan | 315/312 X |
| 4,823,069 | 4/1989 | Callahan | 315/194 X |
| 4,949,020 | 8/1990 | Warren | 315/297 |
| 4,972,125 | 11/1990 | Cunningham | 315/291 |
| 4,977,484 | 12/1990 | Cunningham | 361/429 |
| 5,004,957 | 4/1991 | Cunningham | 315/199 |
| 5,066,896 | 11/1991 | Bertenshaw et al. | 315/291 |
| 5,319,301 | 6/1994 | Callahan et al. | 315/294 X |
| 5,365,148 | 11/1994 | Mallon et al. | 315/194 |

*Primary Examiner*—Robert Pascal
*Assistant Examiner*—Haissa Philogene
*Attorney, Agent, or Firm*—Robert L. Harrington

[57] ABSTRACT

A control service delivers controlled magnitude energy from a sinusoidal power source in the form of a sequence of pulses conforming to the sinusoidal envelope. A gate signal operated at a selected frequency applies gating pulses to a gating device receiving the sinusoidal power signal and applying its output to a load. The load receives, at high gate signal frequencies, substantially all energy presented in the power signal and, at lower gate signal frequencies, a selected magnitude energy taken from the sinusoidal power signal. The power applied to the load does not produce undesirable noise or radio frequency interference and does not require use of an expensive, heavy and volumous choke or inductor.

10 Claims, 12 Drawing Sheets

SINUSOIDAL INDUCTORLESS DIMMER APPLYING VARIABLE FREQUENCY POWER SIGNAL IN RESPONSE TO USER COMMAND

BACKGROUND OF THE INVENTION

The present invention relates generally to power control circuits, and particularly to dimming circuits for lighting and other applications.

Dimming circuits have used SCRs to "chop" or vary the potential of a sinusoidal input wave during each half-cycle by delaying the energy during each half-cycle to, for example, a lighting device. The smooth contoured sinusoidal alternating current power source is turned on from zero potential to the incoming potential at a selected phase angle. By suddenly applying the potential presented to the load, however, the cyclic wave form applied to the load is not properly characterized as a sinusoidal waveform. In deviating from a generally sinusoidal waveform, such dimming functions have found deficiencies. Such dimming methods tend to have little control in the sudden application of power and have required inductors to better control, i.e., extend, ramp time. More particularly, when suddenly applying the potential to the load, the sudden change or step function in voltage and current flow produces undesirable consequences. Use of an inductor as a solution to the step-voltage conditions introduces undesirable radio frequency interference. Furthermore, the basic on time at 90 degree conduction undesirably vibrates light filaments. This filament vibration causes audible interference and is desirably avoided.

More recently, use of insulated gate bipolar transistors IGBTs has been introduced in dimming functions. U.S. Pat. No. 4,633,161 issued Dec. 30, 1986 to Callahan shows an improved inductorless phase control dimmer power stage with semi-conductor controlled voltage rise time. The Callahan configuration only attempts to electronically simulate the prior SCR with inductor chop mode of operation, but with improved ramp control during turn on periods.

The background portion of the Callahan patent covers the history of dimming techniques including one approach to the "chokeless" dimmer as a high wattage power transistor operating in a pure linear mode. FIG. 2 of Callahan illustrates the output of a high wattage power transistor operating in a pure linear mode, however, FIG. 2 of Callahan illustrates an "amplitude clamping" function. Amplitude attenuation by clamping, while superior over phase control amplitude chopping, still introduces some degree of harmonics into the load circuit.

Callahan discusses some heat dissipating issues associated with such linear dimmers, and states that as much as ten times more heat must be dissipated from a linear dimmer relative to that of conventional phase control dimmers. In FIGS. 3A and 3B of Callahan, Callahan proposes pulse width modulation wave forms for application to the load as a solution to heat dissipation issues. FIG. 3B shows the result of introducing an inductor in series with the pulse width modulated wave form prior to application to a load. The use of an inductor, however, to produce such a synthesis of an amplitude-modulated sinusoidal wave form undesirably produces radio frequency interference.

Thus, there remains a need for an "inductorless" dimmer circuit having acceptable rise and fall times, but without excess heat dissipation requirements relative to prior phase control dimmer units. In this manner, the advantages of an inductorless dimmer function are achieved, but without the associated heat dissipation problems. The subject matter of the present invention provides such a dimmer control function.

U.S. Pat. No. 5,365,148 issued Nov. 15, 1994, filed Nov. 19, 1992 by inventors P. Mallon and G. Bateman and assigned to the assignee of the present invention illustrates a dimmer control circuit receiving a dimmer control signal and a sinusoidal power source. The circuit applies an amplitude attenuated form of the sinusoidal power source to a load. The attenuated power source as applied to the load retains or improves the rise and fall time of the original power source and thereby minimizes or eliminates undesirable effects associated with sharp rise and fall events in a cyclic power source.

SUMMARY OF THE INVENTION

A control device applying a selected magnitude energy to a load under the present invention includes a control portion receiving a command value and a gate signal generator receiving the command value and producing a gate signal operating at a frequency corresponding to the command value. A gating device accepts the gating signal and a sinusoidal power source. The gating device reacts to the gate signal by applying portions of the sinusoidal power source to accomplish delivery of a selected magnitude energy to the load.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
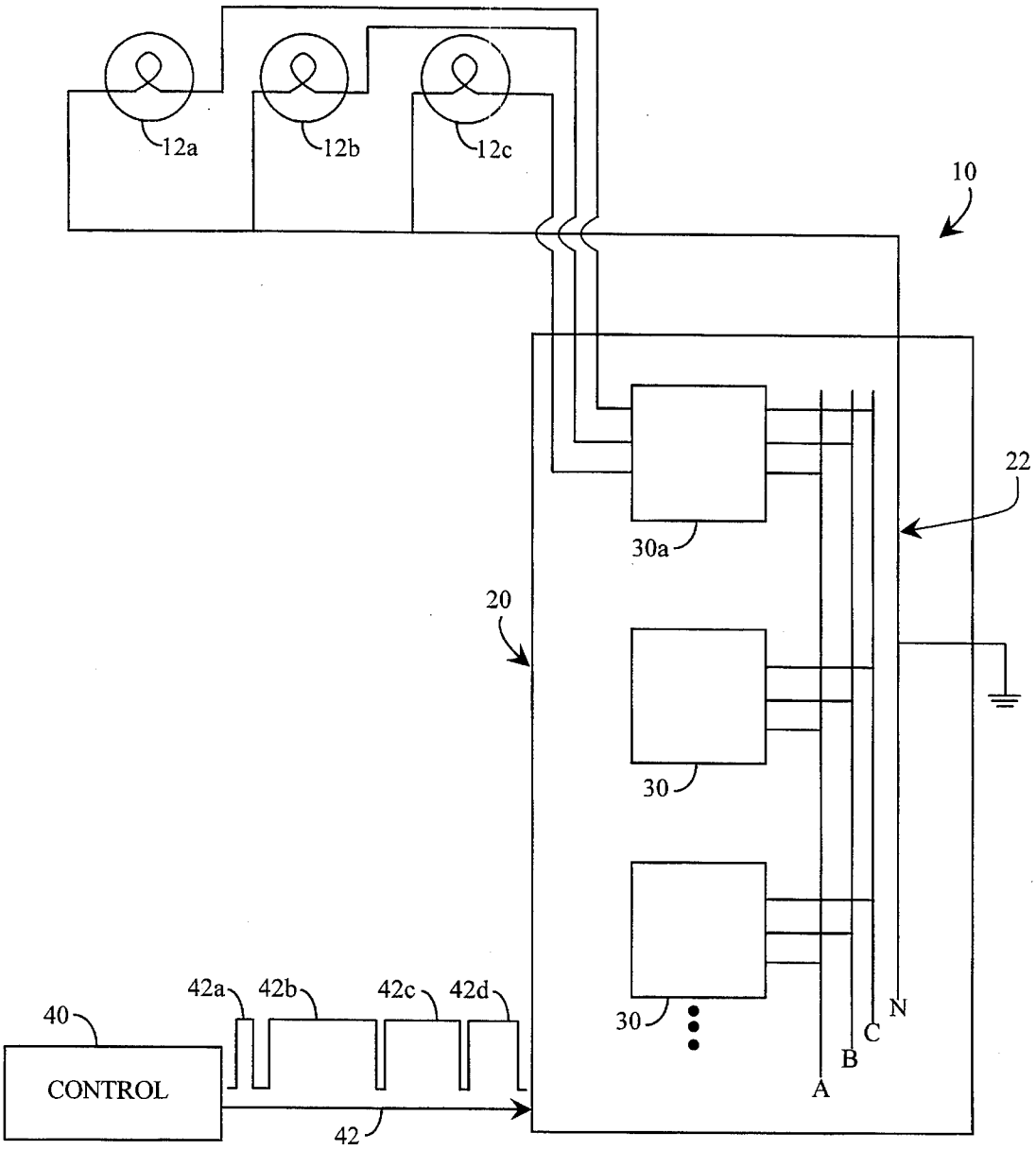
FIG. 1 illustrates generally a lighting system including dimmer control in accordance with a preferred embodiment of the present invention.

FIG. 1 illustrates generally a lighting system 10. Lighting system 10 includes a collection of loads 12, illustrated in FIG. 1 as lamps 12*a*–12*c*. Each load 12 has first and second terminals, the first terminal being connected to the neutral (N) power line and the second terminal 12*b* being coupled to a controlled magnitude load side of a dimmer bank according to the present invention.

A dimmer cabinet 20 provides a three phase (A,B,C) power bus 22 which can be connected either single phase or three phase. Cabinet 20 also includes a plurality of dimmer modules 30. Each of dimmer modules 30 couple to each phase of the three power lines of bus 22. In this manner, each dimmer module 30 provides three load side outputs, each output corresponding to one of the power phase lines A, B, and C of bus 22. As shown in FIG. 1, for example, the dimmer module 30*a* drives lamps 12*a*–12*c* with each of lamps 12 being driven by a controlled magnitude power signal taken from a separate one of the line phases A, B, and C. Thus, coupling between cabinet 20 and lamps 12 comprises a common conductor coupling the neutral side of lamps 12 to a neutral bar of bus 22 and a separate power conductor for each of the lamps 12.

A control 40 provides to cabinet 20 a control signal 42. Control signal 42 may be of a variety of formats, but as illustrated herein is an asynchronous DMX512 transmission protocol providing address values in conjunction with commands whereby each of the dimmer modules 30 may be associated with a base address and respond to commands provided in signal 42 in association with that address or one appropriately offset therefrom. Generally, commands as presented to dimmer modules 30 represent a scaler value in the range 0–255 dictating an intensity of operation for a corresponding lamp 12. More generally, however, such commands represent a magnitude of energy to be delivered to a given load.

Each dimmer module 30 carries independent power supply, processing ability and related resources and operates as a stand alone control device. As a result, each dimmer module 30 may be, if desired, located adjacent the corresponding lamps 12 and the control signal 42 delivered to dimmer module 30 for a more distributed control scheme. Under such distributed control scheme one need not route controlled power lines to the various load entities, but rather may deliver data lines, e.g., signal 42, in implementation of a distributed control architecture.

Figure 2:
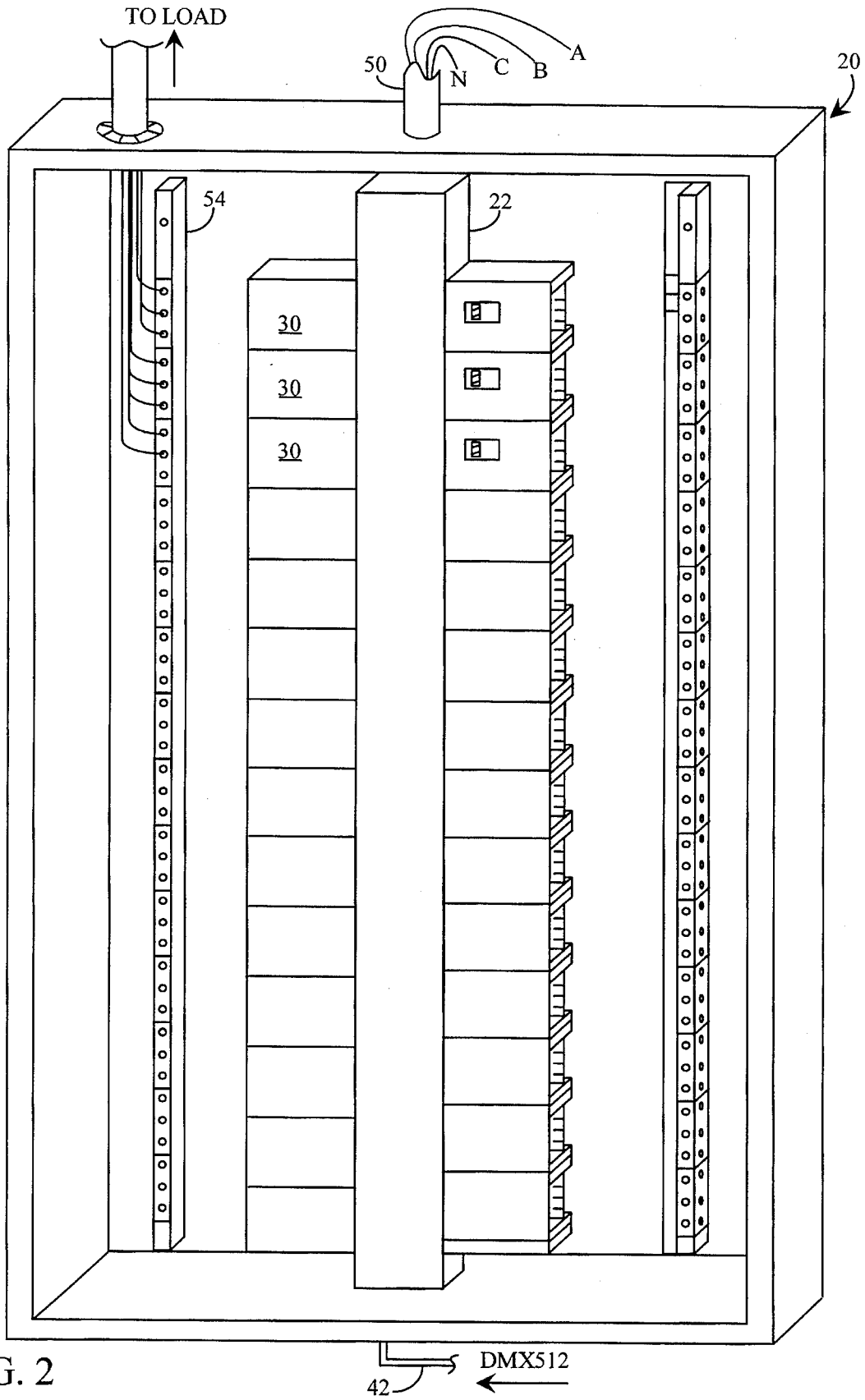
FIG. 2 illustrates a dimmer cabinet wherein dimmer modules of the present invention mount.

FIG. 2 illustrates the dimmer cabinet 20 in more detail. In FIG. 2, a three-phase power source 50 arrives at cabinet 20 and is applied to bus 22 within the plenum of cabinet 20. In this manner, a three-phase power and air duct arrangement is combined and made available throughout cabinet 20. Dimmer modules 30 plug into bus 22 and thereby each have access to each phase of the bus 22. Modules 30 also plug into load blocks 54. In this manner, when cabinet 20 is placed in service, load blocks 54 are coupled to the conductors running to the loads, e.g., coupled to lamps 12.

As used herein, reference to lamp 12 shall also be to a wide variety of devices operable under control of dimmer modules 30. Such devices include motors, fluorescent lamps, incandescent lamps, transformers, and other such devices controlled desirably to a given level of intensity or speed of operation.

Also in FIG. 2, the control signal 42 enters cabinet 20 and is distributed along the plenum of cabinet 20. Each dimmer module 30 monitors activity in control signal 42 and detects presentation of its base address, or one offset suitably therefrom, to collect the associated command and modify its operation accordingly, i.e., dictate the magnitude of energy delivered to the associated load block 54 and thereby dictate operation of an associated load device.

In FIG. 1, the asynchronous protocol of signal 42 begins with a start bit 42*a* followed by an address sequence 42*b* and a set of dimmer levels 42*c*. This protocol corresponds to the well known DMX512 protocol. While illustrated herein as the DMX512 protocol, control signal 42 may be of a variety of formats and embodiments. The basic function of signal 42 under the illustrated embodiment is to provide in association with a given module 30 address an intensity command in the range 0 . . . 255. In particular, each dimmer module 30 is associated with a base address. Sub-channels within each dimmer module 30 are addressed in offset fashion relative to the base address. In the embodiment illustrated herein, therefore, each module 30 includes three sub-channels with the first channel associated with the base address and the second and third channels addressed in offset relation to the base address. Dimmers 30 are thereby individually addressed at each of three control subchannels and may be individually controlled for the purpose of ultimately individually controlling the associated loads, e.g., each of lamps 12*a*–12*c*.

Figure 3:
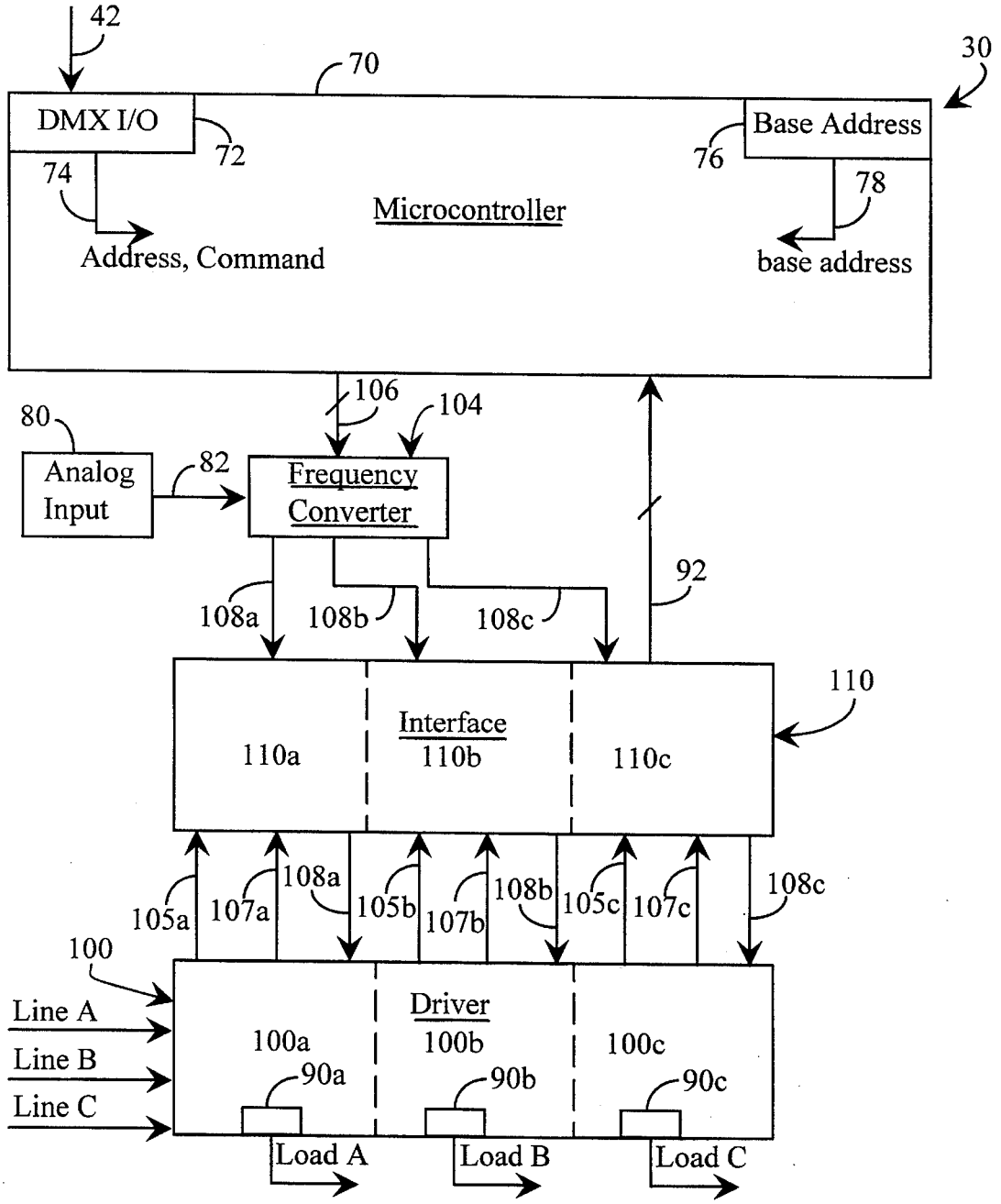
FIG. 3 illustrates in block diagram a dimmer module according to a preferred embodiment of the present invention.

FIG. 3 illustrates in block diagram one of dimmer modules 30. In FIG. 3 a microcontroller 70 dictates operation of each dimmer module 30. In implementation of the present invention, an 87C*51* microcontroller has been utilized as microcontroller 70. A DMX512 input I/O block 72 receives the control signal 42 and delivers to microcontroller 70 address and command data 74 as provided in signal 42. Microcontroller 70 compares the address portion to a base address and to offset addresses associated therewith and, upon address match, implements the associated command portion. An address block 76, e.g., rotary switches, establishes a base address associated with the particular dimmer module 30. Microcontroller 70 reads a base address 78 from address block 76 for comparison to the address portion of address and command data 74. Address block 76 may be implemented according to a variety of methods. For example, address block 76 may simply be a switch box manually set to establish a base address for each dimmer 30. In more sophisticated implementations, however, address block 76 may be established by software control, for example, delivered by way of signal 42 and written in to an address register of microcontroller 70. In any event, each dimmer module 30 has an associated base address whereby commands may be directed to a specific sub-channel by offset addressing relative to the base address. Microcontroller 70 operates generally under a control loop monitoring activity in control signal 42 via I/O block 72 and implementing any commands directed thereto.

An analog input block 80 provides a control signal 82 to microcontroller 70. Block 80 serves as an alternative mechanism for delivering a command to microcontroller 70 and need not be further discussed. Thus, where a control scheme adopted makes use of individual manual manipulation of a dimmer module 30, e.g., such as analog input block 80 constituting several potentiometers, the control signal 82 may represent an analog value, e.g., a voltage in a given voltage range, dictating operation of an associated load.

Each dimmer module 30 also includes a condition detection block 90 for each sub-channel, individually blocks 90*a*–90*c*. Each dimmer module 30 drives three separate loads, individually labeled load A, load B and load C. Each of detection blocks 90*a*–90*c* monitors one of these load outputs for given conditions and provides, ultimately on microcontroller bus 92, indication to microcontroller 70 of detection of a given fault condition. More particularly, each of detection blocks 90*a*–90*c* provides a variable DC voltage 107 with magnitude representing the operating condition of the corresponding power out block 100*a*–100*c*. Driver blocks 110*a*–110*c* accept the respective variable DC voltage values 107*a*–107*c*, convert such values to digital form, and relays a digital representation of condition information provided by detection blocks 90 to microcontroller 70 via bus 92. A second variable DC voltage signal 105 for each channel, individually 105*a*–105*c*, also represents the condition of the corresponding output channel. Signals 105 and 107 are compared to a given threshold voltage to detect condition of the corresponding output channel. Signal 107 represents overcurrent whereas signal 105 represents half wave. Half wave corresponds to a condition such as when one of the gating devices (described hereafter) shorts and passes only half of the AC sine wave. Generally, each detection block 90 comprises a current transformer with its output rectified into a DC voltage.

Each dimmer module 30 includes three power out blocks 100, individually 100*a*, 100*b*, and 100*c*. Each of power out blocks 100*a*–100*c* receives a corresponding one of the power lines A, B, and C. A circuit breaker (not shown) may be interposed between the incoming power lines A, B, and C and corresponding power out blocks 100*a*, 100*b*, and 100*c*. Thus, each power out block 100 receives energy via a corresponding one of the lines A, B, and C and delivers controlled magnitude energy therefrom as a controlled load signal, i.e., as one of load A, load B, and load C signals.

Each power out block 100 is driven by a corresponding frequency convertor 104*a*, 104*b*, and 104*c*. Frequency convertors 104 each are a programmable intelligent controller (PIC) chip and associated latch device. For example, the present embodiment has been implemented by use of the Microchip Product No. 16x Series PIC.

Generally, the frequency convertors 104 receive from microcontroller 70 a command value from microcontroller bus 106 and deliver, via interface board 110, variable frequency square wave gate control signal 108 to the corresponding power out block 100. Interface board 110 includes three separate channels, 110*a*–110*c* corresponding to each of the power out blocks 100*a*–100*c*. Generally, interface board 110 bridges the digital-based frequency convertor block 104 and the analog-based power out blocks 100*a*–100*c*. Interface board 110 optically isolates digital values and control signals provided by frequency convertor 104 for application to the power out blocks 100*a*–100*c*. Furthermore, interface board 110 monitors variable DC voltage signals 105 and 107 from each of the power out blocks 100*a*–100*c* and provides to microcontroller 70 via bus 92 a status indicator for each of the power out blocks 100*a*–100*c*.

In operation, microcontroller 70 receives a scaler value (0 . . . 255) from control signal 42, places the scaler value onto bus 106 for use by frequency convertor block 104. In turn, each frequency convertor block 104 produces the corresponding variable frequency signal 108 for application, via interface board 110, to the power out block 100. Variable frequency signal 108 comprises a sequence of fixed width on pulses separated by variable width off pulses. In effect, the magnitude of the scaler value defines the width of the off time separating on pulses in signal 108. For a greater magnitude scaler value, the fixed width on pulses in signal 108 appear closer together, and, therefore, appear at a higher frequency.

While off-time pulse width is varied in the signal 108, the method of control is not pulse width modulation but rather frequency modulation as explained more fully hereafter. In particular, information as to the magnitude of energy to be delivered to the load lines is represented in the frequency of signal 108. The width of the on pulse provided in signal 108 can be fixed, e.g., 4–6 microseconds, and the frequency of the signal 108 refers to how often this on time pulse occurs.

In an alternate configuration of the present invention, the width of the on pulse provided in signal 108 can vary as a function of the scaler command value to achieve a desired lighting curve. For example, the on pulse in signal 108 can vary between two widths. When the scaler command value is in a lower 50 percent range, the on pulse can be two microseconds and when the scaler command value is in an upper 50 percent range, the on pulse provided in signal 108 can be three microseconds in width. In this manner, a sequence of variable width on pulses separated by variable width off pulses occurs, the variation being a function of the scaler command value. In effect, the magnitude of the scaler command value defines the width of the on and off times separating on pulses in signal 108. For a greater magnitude scaler value, the on pulses in signal 108 appear closer together, and, therefore at a higher frequency. While the on-time pulse width may be varied under such alternate configuration of the present invention, the method of control is not pulse width modulation, but rather frequency modulation as explained more fully hereafter.

Signal 108 may be provided in synchronization with the corresponding power line as desired. As explained more fully hereafter, the corresponding power out blocks 100 respond to this variable frequency signal 108 and provide a controlled magnitude of energy for application to the corresponding lamp 12. The frequency of signal 108 represents the intensity of lamp 12 operation or speed of load device operation. The width of the off pulse provided in each cycle of signal 108 establishes the frequency of signal 108, i.e., wider off pulse width establishes a lower frequency and more narrow off pulse width establishes a higher frequency.

Figure 4:
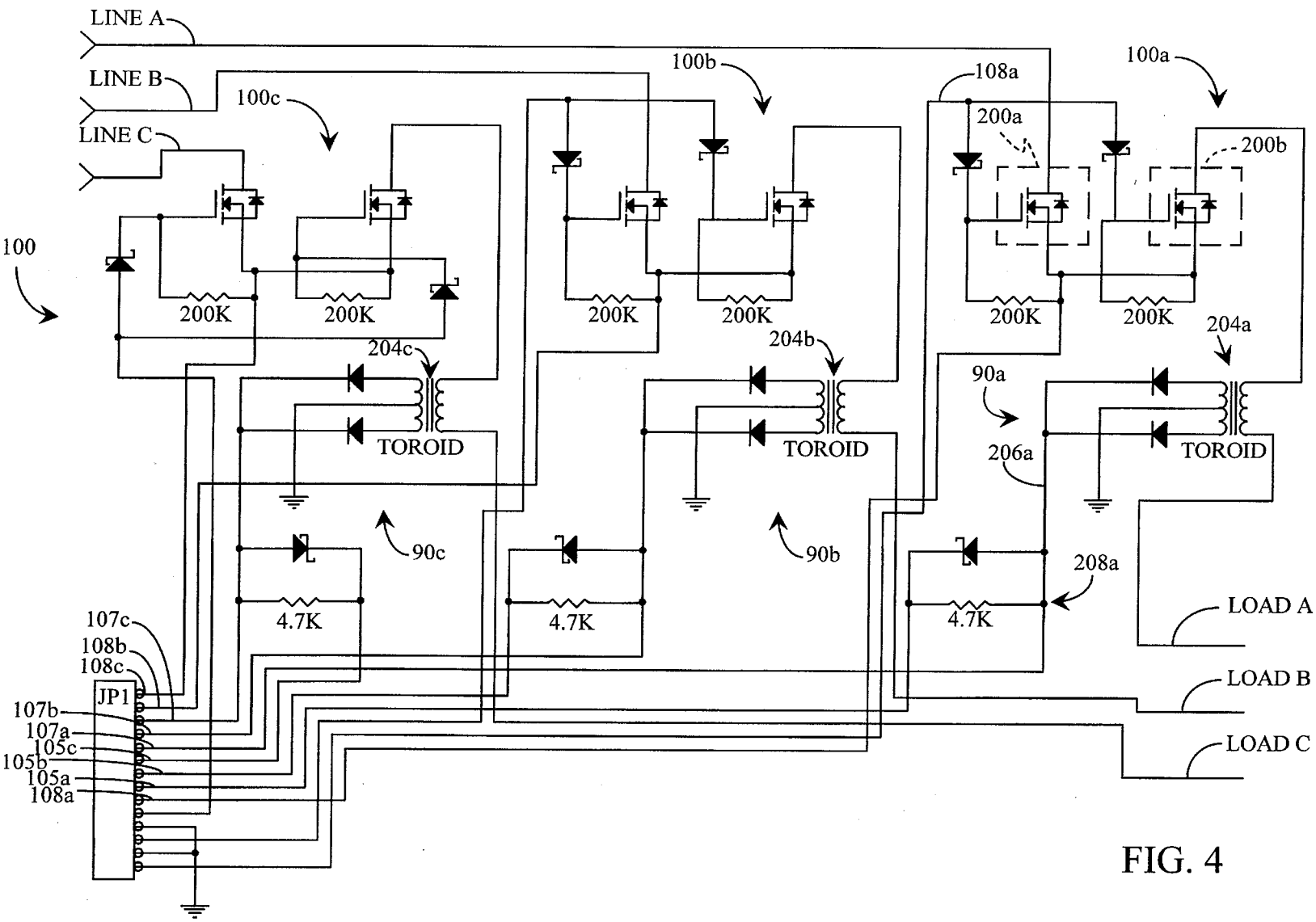
FIG. 4 illustrates by electrical schematic diagram driver circuitry producing a controlled power signal for application to a load in accordance with the present invention.

FIG. 4 illustrates in more detail the power out blocks 100*a*–100*c*. In FIG. 4, each of lines A, B, and C apply to the power out blocks 100*a*, 100*b*, and 100*c*, respectively, and the loads A,B, and C are shown coupled to respective Power Out blocks 100*a*, 100*b*, and 100*c*, respectively. Each of power out blocks 100*a*–100*c* operate identically and the following description of block 100*a* applies to blocks 100*b* and 100*c*. Each of blocks 100*a*–100*c* includes two LCD-MOS blocks 200, individually 200*a* and 200*b*. Each LCD-MOS block 200 comprises product number IRF*360*CL available from International Rectifier. Each block 200*a* operates during the positive half cycle and each block 200*b* operates during the negative half cycle.

Each block 200 includes three terminals. One terminal couples to the corresponding power line, e.g., the first terminal of LCD-MOS block 200*a* couples to the line A input to power out block 100*a*. The second terminal receives the control signal 108. For example, the second terminal of block 200*a* receives the gate signal 108*a*. The third terminal of block 200*a* ties to the third terminal of block 200*b*. The second terminal of block 200*b* also receives the gate signal 108*a*. The first terminal of block 200*b* provides a gated output applied, via current transformer 204*a* of condition detection block 90*a*, to the load A. Current transformer 204*a* generates a DC voltage as a function of current drawn by load A. Variable voltage signal 206*a* corresponds to the variable voltage condition signal 107*a* and the variable half wave voltage signal 105*a* appears as a function of the resistor and diode network 208. Thus, signals 105*a* and 107*a* vary in voltage magnitude as a function of the output of current transformer 204*a*. The magnitude of voltage provided in signals 105*a* and 107*a* is compared to reference voltages for determining the condition of power out block 100*a*. Power out blocks 100*b* and 100*c* operate in similar fashion to that of block 100*a* as described herein.

By gating the power line A as a function of on pulses in signal 108, the load A receives a series of pulses each within the envelope of the sine wave of the line A phase. Essentially, each LCD-MOS device 200 is a switching device responsive at the frequency of signal 108 to gate the power line. The control signal 108*a* is a constant amplitude variable frequency pulse train. The power signal applied to the load, however, follows the line phase amplitude, but appears as a series of energy pulses corresponding in frequency to that of control signal 108*a*.

Figure 5:
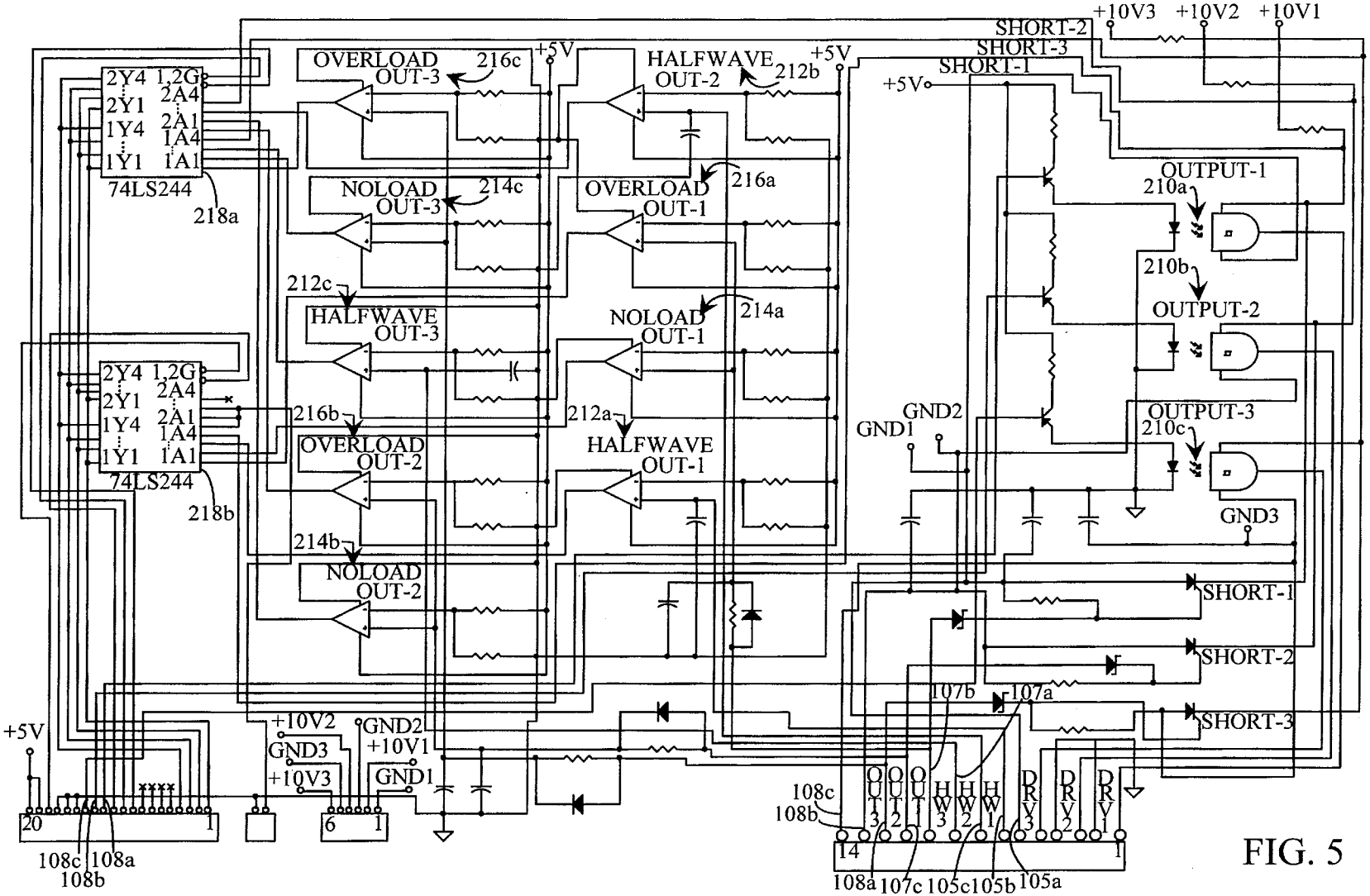
FIG. 5 is an electrical schematic diagram of an interface board interposed between the driver circuitry of FIG. 4 and frequency convertor circuitry of FIG. 6.

FIG. 5 illustrates schematically the driver board 110. In FIG. 5, gate control signals 108*a*–108*c* are applied to corresponding ones of opto isolators 210*a*–210*c*. The output of each opto isolator 210 is then applied directly to the gate of the corresponding LCD-MOS blocks 200 (FIG. 4). Each variable voltage signal 105 applies to a corresponding one of half wave comparators 212*a*–212*c*. Similarly, each of variable voltage signals 107*a*–107*c* applies to corresponding no load comparators 214*a*–214*c* and overload comparators 216*a*–216*c*. Outputs taken from comparators 212–216 are collected in latches 218 and made available on bus 92.

Generally, each half wave comparator 212 indicates fault of an operating condition within the dimmer, i.e., within the corresponding LCD-MOS block 200. Each no load comparator 214 indicates lack of load applied to the corresponding power out block 100. Each overload comparator 216 indicates fault, i.e., excess current draw, in either the corresponding power out block 100 or in the load itself, e.g., a short in the corresponding lamp or lamp fixture.

Figure 6:
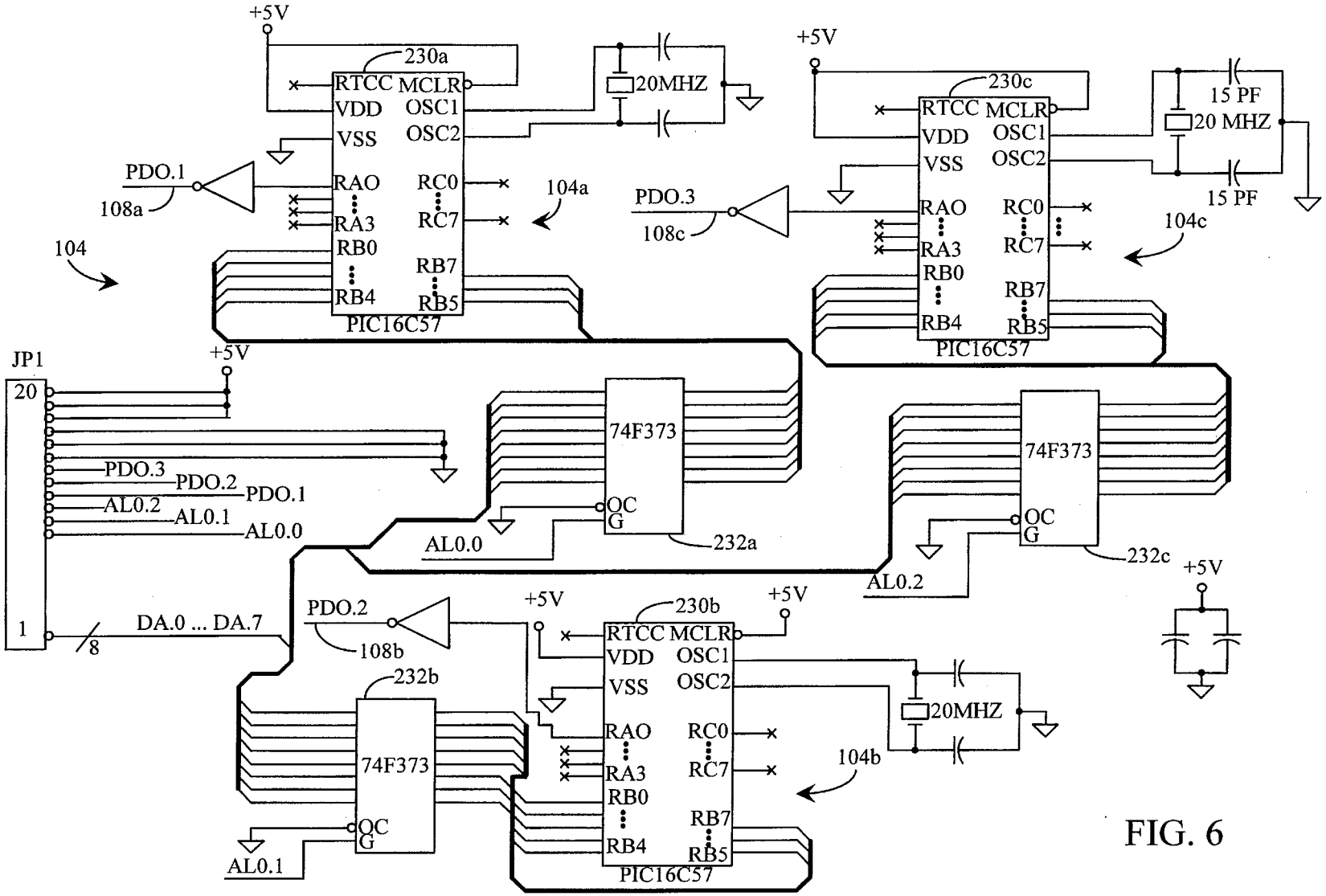
FIG. 6 illustrates by electrical schematic diagram frequency convertor circuitry in implementation of a preferred embodiment of the present invention.

FIG. 6 illustrates generally the frequency convertor blocks 104*a*–104*c*. In FIG. 6, each frequency convertor block 104 includes a programmable intelligent controller (PIC) 230 and an associated latch 232. Thus, each PIC 230 receives a scaler intensity value and produces a corresponding variable frequency gate control signal 108. Each latch 232 holds the corresponding incoming scaler intensity command value as provided by microcontroller 70. Thus each PIC 230 intermittently reads the value held in the corresponding latch 232 and produces a gate control signal 108 corresponding in frequency thereto.

Figure 7:
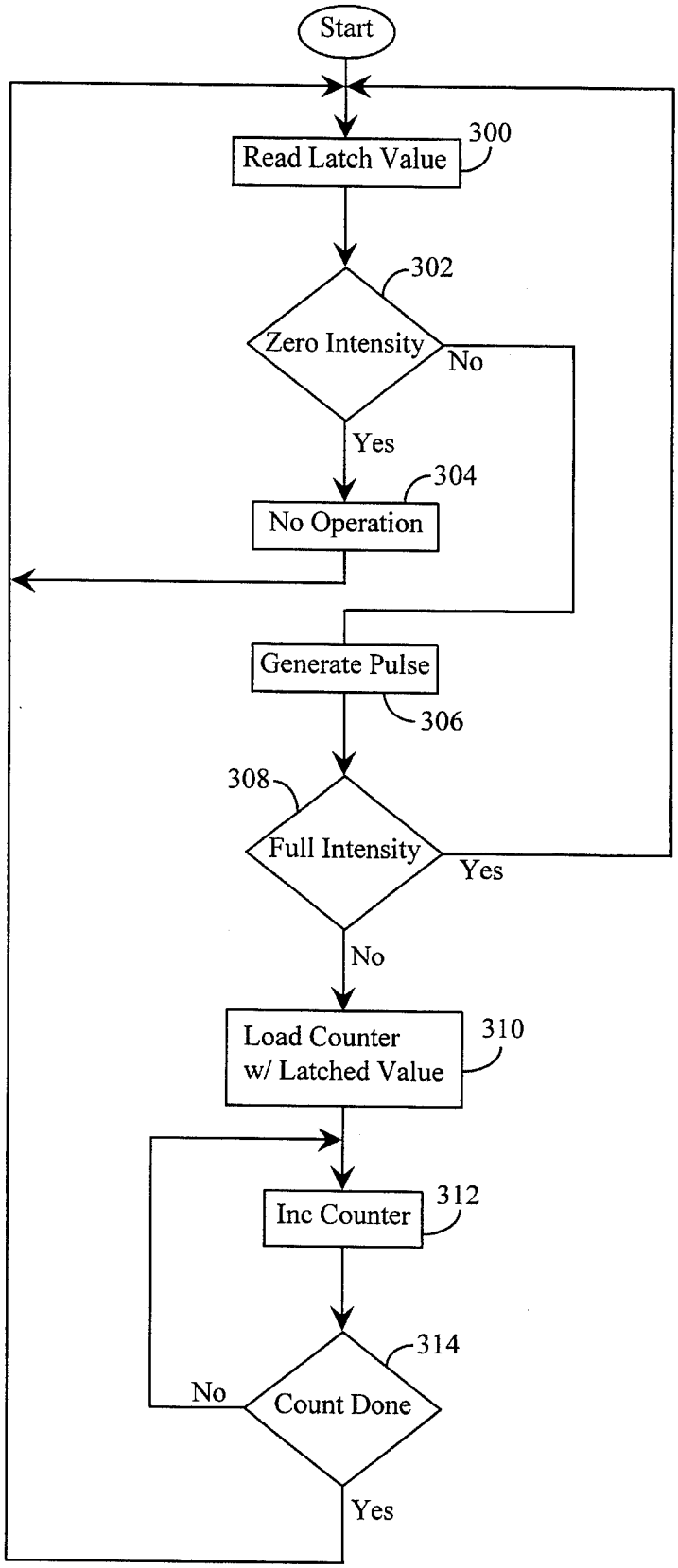
FIG. 7 is a flow chart illustrating control executed by each channel of the frequency convertor circuitry of FIG. 6.

Microcontroller 70 loads intermittently through bus 106 the intensity command values, in the range 0 . . . 255, into the latches 232 as a function of signal 42. Each PIC 230 cycles in a control loop reading in each cycle the value in the corresponding latch 232 and performing programming as indicated generally in the flow chart of FIG. 7. In FIG. 7, each PIC 230 first reads in block 300 a latch value taken from its associated latch 232. In decision block 302, each PIC 230 compares the intensity command value found in its associated latch 230 and compares this value to a zero intensity command. If a zero intensity command is indicated in block 302, processing advances to block 304, representing a no operation step, and returns to block 300. If, however, decision block 302 indicates a non-zero intensity command, then processing advances to block 306 where PIC 230 generates a fixed width pulse, i.e., an on pulse in the gate signal 108. While indicated herein as a fixed width pulse, such pulse width may be modified if desired as a function of the intensity command value taken from latch 232. In any event, the on pulse produced in block 306 is applied to the gate of the corresponding pair of LCD-MOS blocks 200*a* and 200*b* whereby, for the duration of such pulse, the line power is passed through to the load. Following the on pulse, the power line is isolated by blocks 200 from the load line. Continuing to decision block 308, if a full intensity command is indicated in the latched value, then processing returns to block 300. Thus, for a full intensity command each PIC 230 simply cycles producing at high frequency the on pulse in gate signal 108. In the embodiment of the present invention, such full intensity frequency is on the order of 250 KHz.

If a full intensity command is not indicated in decision block 308, then processing advances to block 310 where PIC 230 loads a counter with the latched value, i.e., loads the counter with the intensity command. Processing then advances to block 312 where PIC 230 increments the counter and then to decision block 314 where the counter value is tested against a full count value. If a full count value has not yet occurred, then processing returns to block 312. If, however, a full count condition exists in the counter, then processing returns to block 300.

Thus, for a large magnitude intensity command, gating or on pulses generated in block 306 occur at relatively high frequency whereas a low magnitude intensity command introduces additional delay between gating pulses produced in block 306. In this manner, the magnitude of energy applied to a load is a function of the intensity command value.

Figure 8:
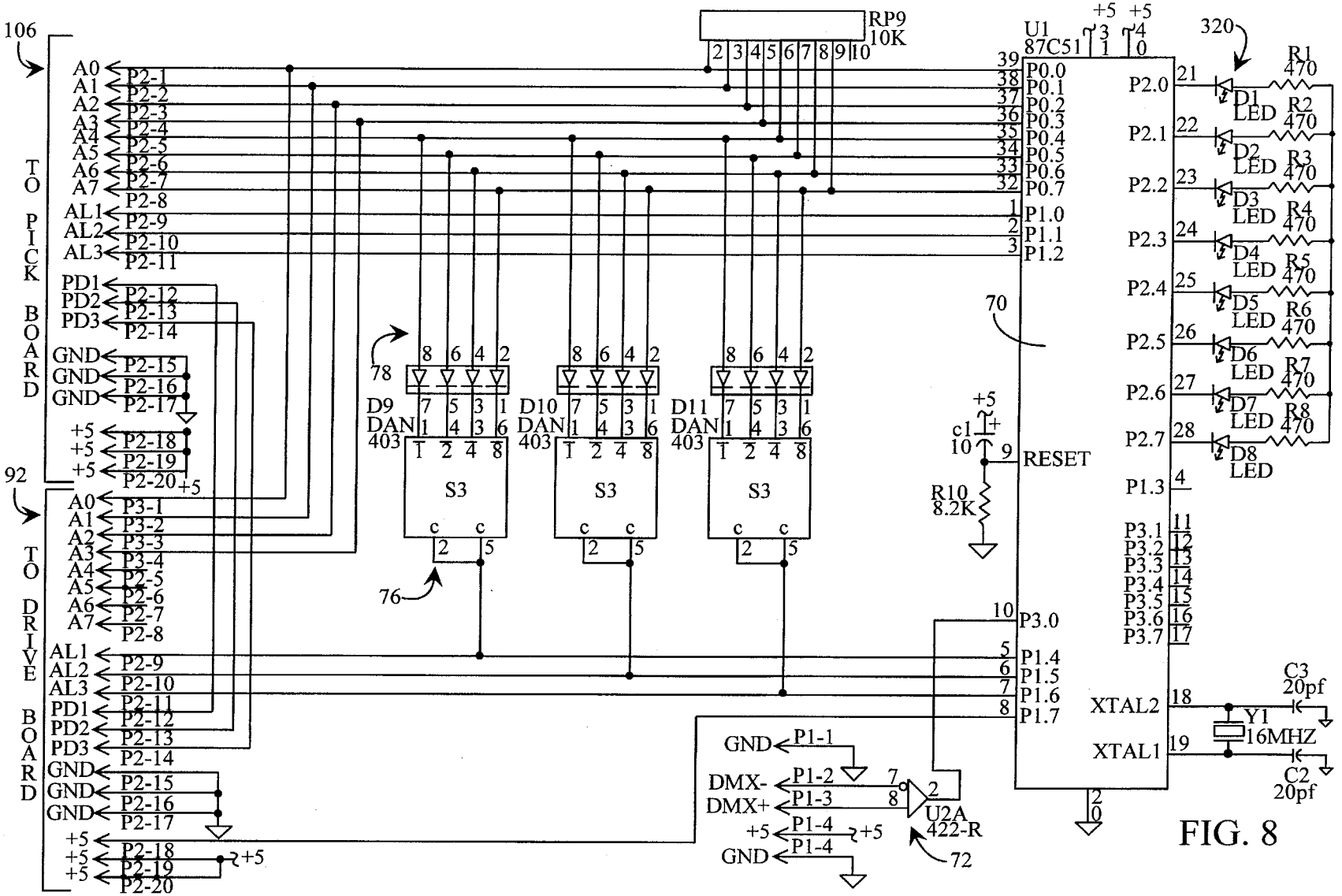
FIG. 8 is an electrical schematic diagram of a microcontroller circuit in implementation of a preferred embodiment of the present invention.

FIG. 8 illustrates the CPU and display features of device 10. Microcontroller 70 includes a bank of LEDs 320 to indicate the condition of various output channels for module 30. Microcontroller 70 interacts on busses 106 and 92 with the frequency convertor blocks 104 and interface blocks 110, respectively, as described herein above. Generally, microcontroller 70 drives command values onto bus 106 for latching into an appropriate one of latches 232 of frequency convertor blocks 104*a*–104*c*. Microcontroller 70 receives from interface blocks 110*a*–110*c* condition information as developed at the detection blocks 90*a*–90*c* by way of bus 92 and presents such information at LED bank 320. Base address block 76 comprises a set of three switch boxes each providing a four bit value to establish a base address 78 for the particular dimmer module 30.

Programming for microcontroller 70 generally requires that the DMX510 I/O block 72 be monitored for occurrence of commands having addresses in an appropriate range, i.e., relative to the base address 78. When microcontroller 70 detects a command with address corresponding to one of its sub-channels, microcontroller 70 takes the associated intensity command and latches such value into an appropriate one of latches 232 as indicated by the associated address in signal 42. Microcontroller 70 monitors activity on bus 92 and indicates the condition of each sub-channel by representation on the bank of LEDs 320.

Figure 9A:
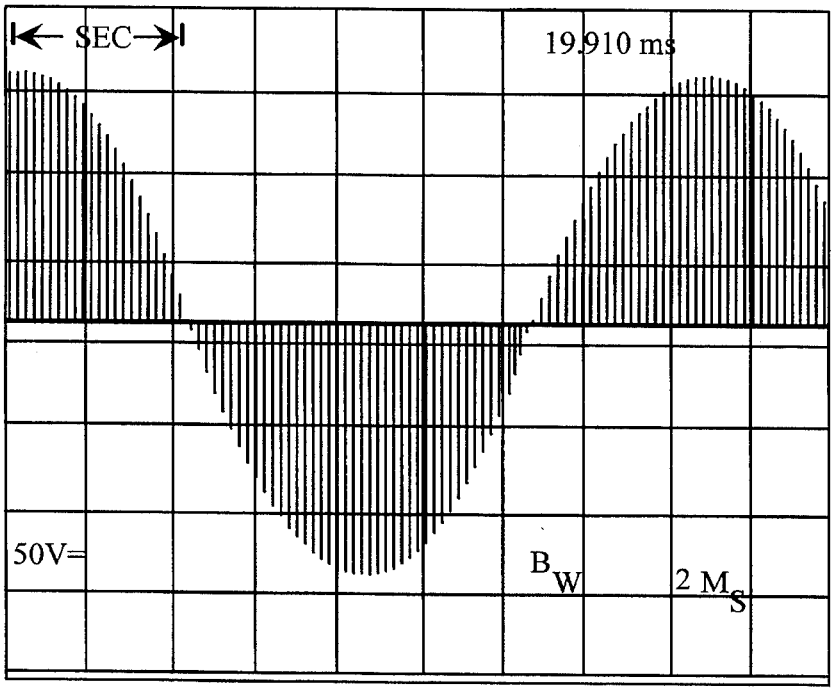
FIGS. 9A–9C, 10A–10B, and 11A–11B illustrate waveforms produced in the device of the present invention at 25 percent, 50 percent, and 100 percent, respectively, power output.
Figure 9B:
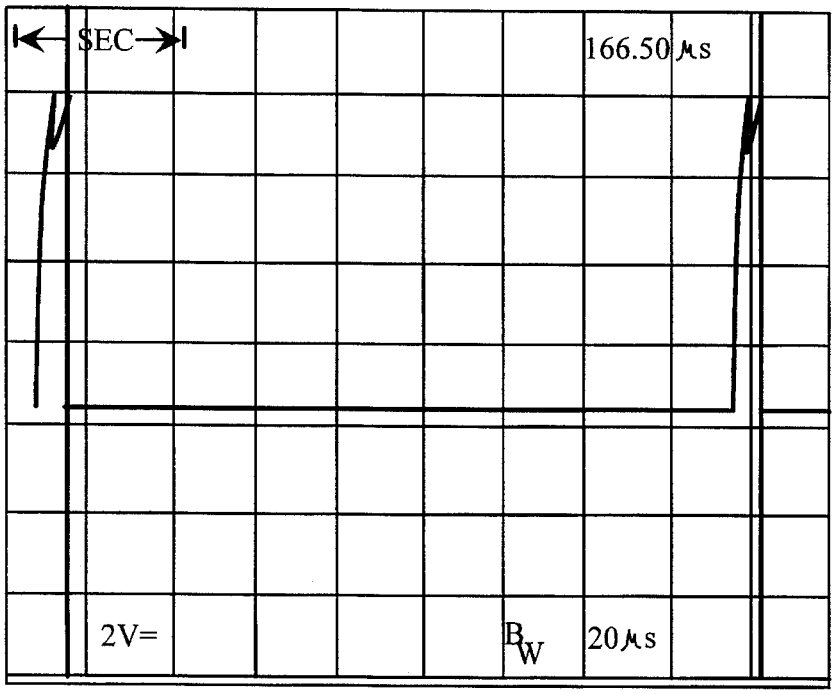
Figure 9C:
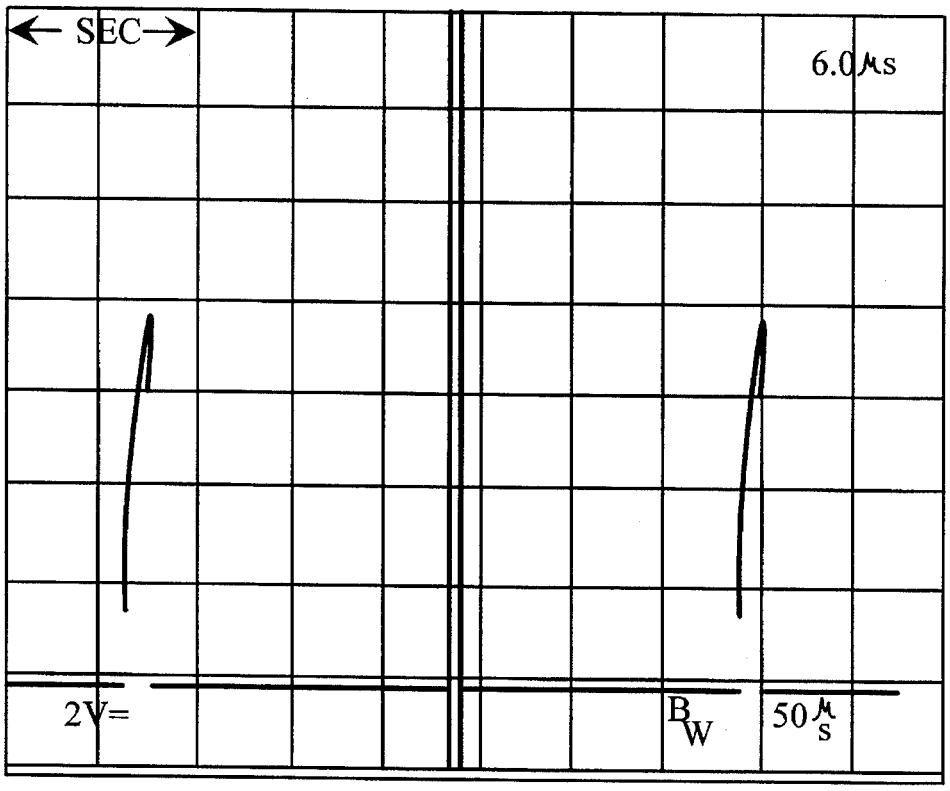

FIGS. 9A–9C illustrate waveforms developed by a dimmer module 30 at 25 percent power output relative to power available in the line power. FIG. 9A illustrates power applied to the load, FIG. 9B illustrates the off time for the off portion of signal 108 and FIG. 9C illustrates the on time for the on portion of signal 108. The width of the off portion illustrated in FIG. 9B is 160.5 microseconds and the pulse width for the on portion of signal 108 in FIG. 9C is six microseconds. The on portion of signal 108 drives the gate devices 200 to saturation to produce the waveform illustrated in FIG. 9A. As seen in FIG. 9, the power applied to the load maintains a sinusoidal characteristic. In particular, energy applied to the load arrives as bursts of energy, corresponding to the on portion of signal 108, maintained within the envelope of the original line power sine wave.

Figure 10A:
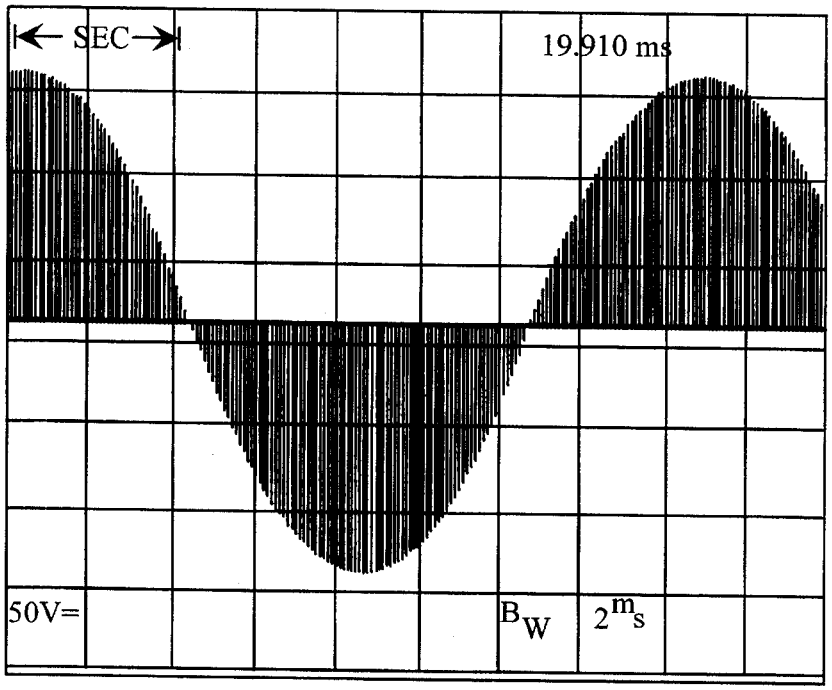
Figure 10B:
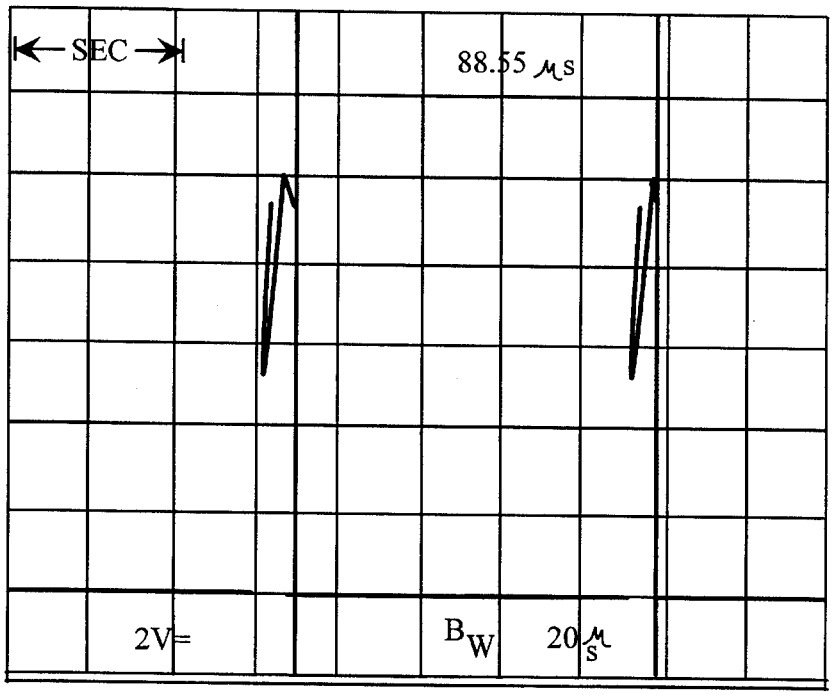

FIGS. 10A and 10B illustrate operation of dimmer module 30 at approximately 50 percent power output relative to the line power provided. In FIG. 10B, the off time portion of signal 108 is 82.55 microseconds. The on portion of signal 108 remains at six microseconds in this example. As seen in FIG. 10A, the output waveform maintains generally the sinusoidal characteristics of the incoming line power, but contains only 50 percent of the energy available in the line power signal.

Figure 11A:
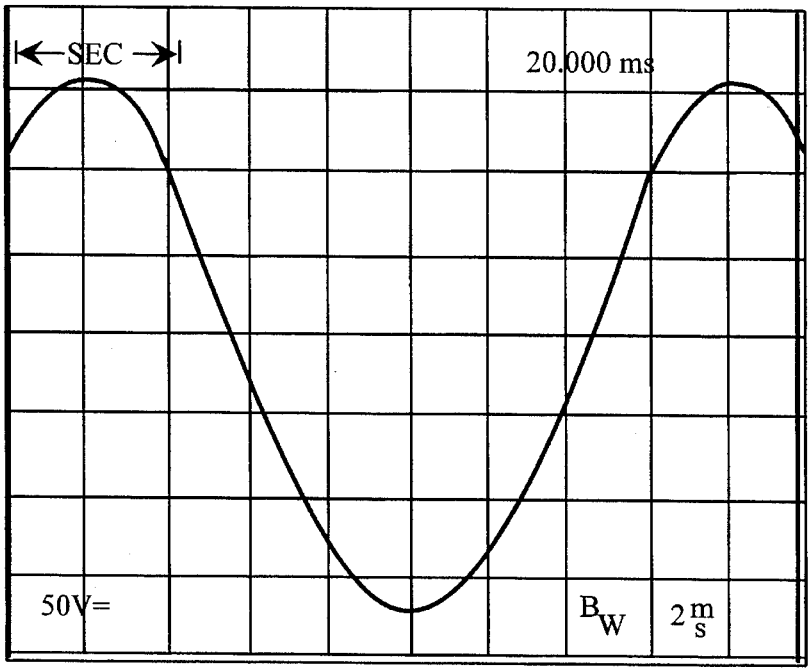
Figure 11B:
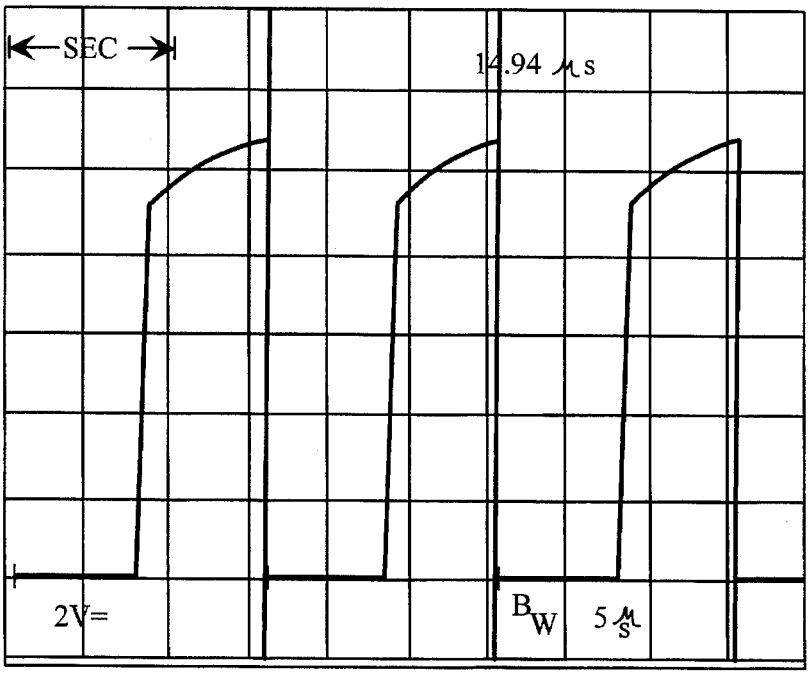

FIGS. 11A and 11B illustrate operation of dimmer module 30 at approximately 100 percent power output. In FIG. 11A, the output signal generally appears as a line power sinusoidal signal. The off portion, illustrated in FIG. 11B, pulse width is only 8.94 microseconds. Accordingly, the gate devices 200 are driven into saturation and substantially remain at saturation due to the very short off time portion of signal 108. Accordingly, virtually 100 percent of the power available in the line power is delivered to the load as indicated in FIG. 11A.

It will be appreciated that the present invention is not restricted to the particular embodiment that has been described and illustrated, and that variations may be made therein without departing from the scope of the invention as found in the appended claims and equivalents thereof. While shown herein as three separate power out blocks in each dimmer module 30, i.e., corresponding to three separate phase power lines, the present invention need not be limited to use of three separate power out blocks. In other words, each dimmer module 30 can include any number of control channels and be associated with any number of power out blocks and control over a corresponding number of loads 12. In the present illustration, however, three control channels are provided in each dimmer module 30 in implementation of control by three separate phase power sources.

What is claimed is:

1. A control device responsive to a user command and applying a selected magnitude energy to a load, the control device comprising:

a control receiving said user command as a command value;

a gate signal generator receiving said command value and producing a gate signal maintained given at a frequency corresponding to said command value; and a gating device receiving said gate signal and a sinusoidal power source whereby said gating device applies said selected magnitude energy to said load at said frequency, said frequency being at least greater than twice the frequency of said sinusoidal power source.

2. A control device according to claim 1 wherein said gate signal is varied in frequency as a function of said value.

3. A control device according to claim 1 wherein said gate signal is varied by variation in one of an on time portion and an off time portion thereof, said on time portion causing said gate device to pass said sinusoidal power source to said load.

4. A control device according to claim 1 wherein said device varies multiple on and off times per half cycle of said sinusoidal power signal for different magnitudes of output power levels.

5. A method of delivering a controlled magnitude energy to a load in response to a user command, said method comprising the steps:

receiving a sinusoidal power signal having a first given frequency;

receiving said user command as a command value representing a desired output power level;

producing a gate signal having a second given frequency maintained as a function of said desired output power level; and applying said gate signal to a gating device receiving said sinusoidal power signal and passing said power signal to said load during an on time of said gate signal.

6. A method according to claim 5 wherein said gate signal varies in frequency as a function of said command.

7. A method according to claim 5 wherein said gate signal varies one of said on time and an off time thereof as a function of said desired output power level.

8. A method according to claim 5 wherein said gate signal varies multiple on and off times per half cycle of said sinusoidal power signal for different magnitude of said desired output power level.

9. A control device applying a selected magnitude power level to a load in response to a user command, the control device comprising:

a dimming command receiving device collecting said user command as a dimming command and producing a gate signal, said gate signal including alternating on portions and off portions, said on portions occurring at a given frequency maintained to said dimming command; and a gating device receiving a sinusoidal power signal and said gate signal, said gating device being coupled to said load, said gating device applying said sinusoidal power signal to said load during said on portions of said gate signal.

10. A control device according to claim 9 wherein said gate signal frequency is greater than twice the frequency of said sinusoidal power signal.

* * * * *